US009115501B2

(12) United States Patent
Rucinski et al.

(10) Patent No.: US 9,115,501 B2
(45) Date of Patent: Aug. 25, 2015

(54) METHOD AND APPARATUS FOR MOUNTING A DOOR FRAME IN A BUILDING

(71) Applicant: Sci-Pro.Org, LLC, Saline, MI (US)

(72) Inventors: Kevin John Rucinski, Saline, MI (US); Scott Allen Behr, Howell, MI (US)

(73) Assignee: SCI-PRO.ORG, LLC, Saline, MI (US)

( * ) Notice: Subject to any disclaimer, the term of this patent is extended or adjusted under 35 U.S.C. 154(b) by 0 days.

(21) Appl. No.: 14/217,598

(22) Filed: Mar. 18, 2014

(65) Prior Publication Data

US 2014/0260075 A1 Sep. 18, 2014

Related U.S. Application Data

(60) Provisional application No. 61/802,900, filed on Mar. 18, 2013.

(51) Int. Cl.

| | |
|---|---|
| ***E06B 1/02*** | (2006.01) |
| ***E06B 1/12*** | (2006.01) |
| ***E06B 1/56*** | (2006.01) |
| ***E04F 21/00*** | (2006.01) |
| ***E06B 1/60*** | (2006.01) |

(52) U.S. Cl.

CPC ..... *E04F 21/0015* (2013.01); *E06B 1/6023* (2013.01)

(58) Field of Classification Search

CPC ..... E06B 1/20; E06B 1/02; E06B 1/6023; E04F 21/0015

USPC ..... 52/745.15, 745.16, 211–213, 204.53, 52/215, 217; 49/504–505

See application file for complete search history.

(56) References Cited

U.S. PATENT DOCUMENTS

| | | | | | |
|---|---|---|---|---|---|
| 2,541,871 | A | | 2/1951 | Heijmer et al. | |
| 3,320,705 | A | | 5/1967 | Downing, Jr. | |
| 3,724,135 | A | | 4/1973 | Heliotes | |
| 3,788,019 | A | * | 1/1974 | Kiselewski | 52/212 |
| 4,281,480 | A | * | 8/1981 | Wendt | 49/504 |
| 4,308,692 | A | | 1/1982 | Rumble et al. | |
| 4,674,248 | A | * | 6/1987 | Hall | 52/212 |
| 5,216,856 | A | | 6/1993 | Schroeder | |
| 5,575,123 | A | * | 11/1996 | Adams | 52/212 |
| 5,771,644 | A | * | 6/1998 | Kidd | 52/213 |
| 5,787,660 | A | * | 8/1998 | Adams | 52/212 |
| 5,845,439 | A | * | 12/1998 | Hendley | 52/204.1 |
| 6,192,638 | B1 | | 2/2001 | Wang | |
| 6,286,274 | B1 | * | 9/2001 | McKann et al. | 52/204.1 |
| 7,716,886 | B2 | | 5/2010 | Gordon | |
| 2001/0023557 | A1 | | 9/2001 | Graham | |
| 2009/0126278 | A1 | * | 5/2009 | Dixon | 49/381 |
| 2011/0283624 | A1 | * | 11/2011 | Baer | 49/397 |

* cited by examiner

*Primary Examiner* — Jeanette E Chapman

(74) *Attorney, Agent, or Firm* — Young Basile Hanlon & MacFarlane P.C.

(57) ABSTRACT

The present invention provides a method and apparatus for mounting a door frame into a door opening of a building and includes a pair of substantially similar brackets, a door support frame, and a trim frame. The brackets are connectable to the door opening, the door support frame is connected to the brackets, and the trim frame is connected to the door support frame. The brackets may have a slotted aperture for adjusting the brackets horizontally along a fastener. The brackets may also have an inward taper or ramp for adjustably receiving the door support frame. The brackets are connected to the door support frame through the use of mounting pins, slots, spring clips, integral pins, or a frame insertion tab.

16 Claims, 9 Drawing Sheets

FIG. 3
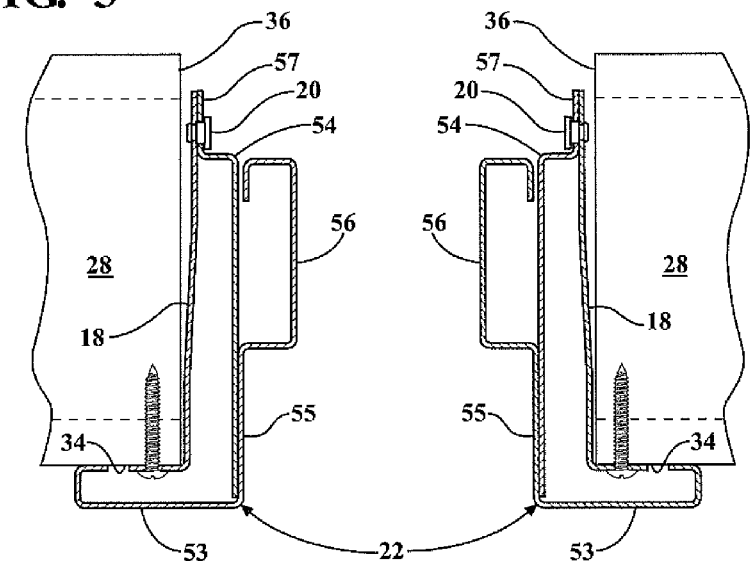
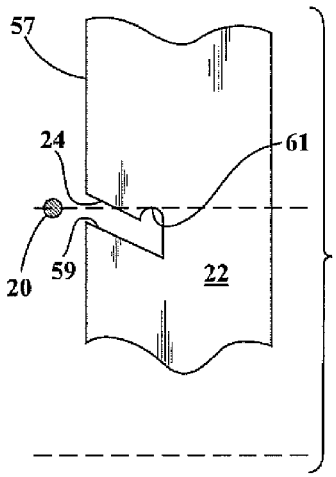
FIG. 3A
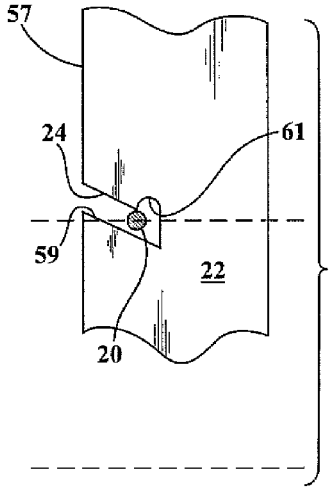
FIG. 3B
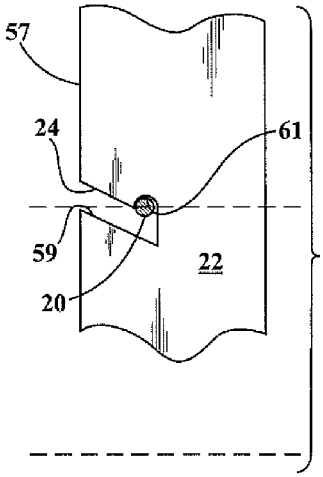
FIG. 3C

METHOD AND APPARATUS FOR MOUNTING A DOOR FRAME IN A BUILDING

CROSS-REFERENCE TO RELATED APPLICATIONS

This application claims the benefit of U.S. Provisional Application Ser. No. 61/802,900, filed on Mar. 18, 2013, which is incorporated herein in its entirety by reference.

FIELD OF THE INVENTION

The present invention relates to a method and apparatus for mounting a door frame in an opening of a building, and more particularly, a method and apparatus that provides for the rapid installation of a steel door frame into a doorway of a building that requires a minimal amount of labor and time for installation.

BACKGROUND

Welded steel door frame systems are widely used in the construction of commercial buildings. These welded steel door frames are known for their high-strength, long service life, and one-piece finished appearance. Non-welded steel frame door systems are known to be used in the commercial construction industry as well, such as knocked down or multi-pieced designs, but such designs are not perceived as delivering the same value and benefits as a welded steel door frame system.

The installation of these welded steel door frame systems is labor intensive and driven by a complex logistics process. For instance, the design and construction of a typical one-piece steel door frame requires the door frame to be installed during the process of constructing the walls of the building which surround the door frame. As a result, the installation of the steel door frame must take place well in advance of the installation of the associated doors and door hardware. Because the steel door frames are installed early in the construction process, the steel door frames are susceptible to damage from construction activities taking place in and around the door openings.

In addition, the installation of a steel door frame typically requires multiple steps. That is, the steel door frames must first be assembled and installed, and then the associated doors are subsequently installed with their respective hardware. This typically requires several deliveries to the construction site due to the multiple component nature of the door frames and the associated door and hardware. Due to the weight of the door frame and the associated door, as well as the complexity of assembling the door frame and the associated door, the installation of the door frame and the door typically requires at least two laborers and multiple trips to and from the door opening to acquire and install the necessary components. Such installations are therefore inefficient and undesirable in the building industry.

As previously noted, there are typically a number of components involved in assembling the steel door frame, as well as the associated door and hardware. Thus, the site logistics for such components can be difficult, as the frames are often delivered to the job site in large quantities and have to be stored on site where storage space is typically limited. Often such components are moved numerous times prior to the installation of the door frame and associated door and hardware, thereby subjecting the components to possible damage and loss. This, of course, creates further inefficiencies that are undesirable in the building industry.

In light of these problems and inefficiencies with installing steel door frames and their associated doors and hardware, it would be desirable to provide a method and apparatus for mounting a steel door frame to a doorway in a building that reduced the total project costs, shortened construction lead times, improved installed quality, and created more efficient site logistics to increase the efficiency of installing such steel door frames.

SUMMARY OF THE INVENTION

The present invention provides a method and apparatus for mounting a door frame into a door opening of a building wherein the door opening is defined by a pair of substantially parallel side surfaces of the walls, and a floor substantially parallel to a top surface of the walls, wherein the floor and the top surface extend between the side surfaces of the walls. The present invention includes a pair of substantially similar brackets, wherein each one of the brackets is connectable to one of the pair of side surfaces of the wall. A door support frame is connected to the brackets, and a trim frame is connected to the door support frame for securing the trim frame in the door opening of the building.

Each of the brackets may include a slotted aperture for receiving a fastener connectable to the walls wherein the brackets may adjustably slide along the fastener relative to the side surfaces of the walls. Each of the brackets may have an inward taper or ramp that allows an end portion of each bracket to extend inward and away from the side surfaces of the walls for engaging the door support frame.

Each of the brackets may have one of a mounting pin or a slot formed therein, and the door support frame may have the other of the mounting pin or slot formed therein, such that the mounting pin engages the slot, thereby connecting the door support frame to the brackets. Each of the mounting pins may have a substantially circular head connected to a smaller stem, wherein the stem is smaller than the slot for engaging the slot, and the head is larger than the slot to prevent the head from passing through the slot, thereby connecting the door support frame to the brackets. Each of the slots may have an open-ended portion extending angularly downward or horizontal with an upward, closed-ended portion in communication with the angularly downward or horizontal portion of the slot.

The door support frame may have a generally U-shaped configuration that extends along the side surfaces, top surface, and front surface of the walls and a generally L-shaped cross-sectional configuration with a short leg and long leg. A substantially rectangular jamb is connected to the longer leg of the door support frame. The trim frame may extend between the jamb and the longer leg of the door support frame to connect the trim frame to the door support frame.

BRIEF DESCRIPTION OF THE DRAWINGS

The various features, advantages and other uses of the present apparatus will become more apparent by referring to the following detailed description and drawing in which:

FIG. 3 is a sectional top plan view of the door opening showing the brackets connected to a door support frame of the apparatus and method for mounting a door frame of the present invention;

FIG. 3A-3C is a schematic diagram showing a lift and drop embodiment of the mounting pin relative to the slot in the door support frame of the apparatus and method for mounting a door frame of the present invention;

DETAILED DESCRIPTION

Figure 1:
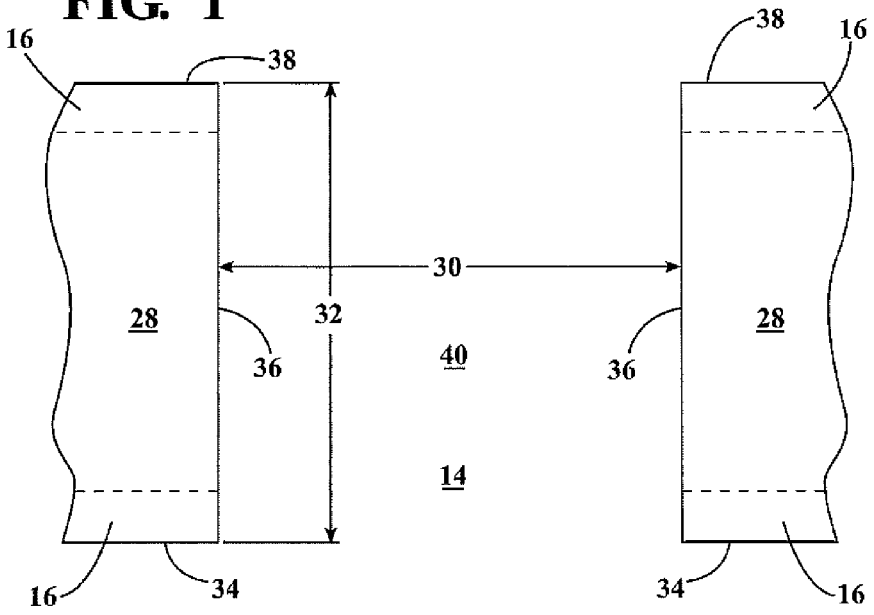
FIG. 1 is a sectional top plan view of a door opening in a building for receiving the apparatus and method for mounting a door frame of the present invention.

The present invention provides a method and apparatus 10 for mounting a door frame 12 into a door opening 14 of a building (not shown). As seen in FIGS. 1-9, the method and apparatus 10 of the present invention is utilized to increase the efficiency of mounting the door frame 12 into the door opening 14 of the building. The method and apparatus 10 of the present invention provides a pair of substantially similar brackets 18 that are adjustably mounted to walls 28 of the building defining the door opening 14. Each of the brackets 18 has a mounting pin 20 that extends inward toward the door opening 14 wherein the mounting pins 20 directly oppose one another. A three-sided door support frame 22 is received by the door opening 14 and may be mounted within the door opening 14 with or without a door (not shown) connected to the door support frame 22. The door support frame 22 is connected to the brackets 18 by having opposing slots 24 formed in the door support frame 22. The mounting pins 20 on the brackets 18 are received by the slots 24 in the door support frame 22, thereby positioning and securing the door support frame 22 onto the brackets 18 and into the door opening 14 of the building. A three-sided trim frame 26 is received from the opposite side of the door opening 14, and the trim frame 26 is connected to the door support frame 22 to secure the trim frame 26 to the door support frame 22 and the brackets 18. Once fully installed, the door frame 12 is ready to have the door connected to the door frame 12 through the use of hinges (not shown) and associated hardware (not shown) if the door was not previously connected to the door support frame 22. If the door was previously connected to the door support frame 22, then only the associated door hardware need be assembled to the door.

The method and apparatus 10 of the present invention may be used to install the door frame 12 into the door opening 14 of the building, as seen in FIG. 1. The door opening 14 is defined by a pair of the opposing walls 28, which may be constructed from wood or steel, wherein plasterboard 16 may cover the outer surfaces of the walls 28. The door opening 14 is further defined by the width 30 between the opposing walls 28 and the depth 32 defined by the width of the walls 28. The width 30 and depth 32 of the door opening 14 typically have "rough" or approximate dimensioning, meaning that these dimensions do not have a fine tolerance specification. The door opening 14 is further defined by the walls 28 having a front surface 34, a side surface 36, and a rear surface 38. The door opening 14 is also defined by a floor 40 of the building and a top surface (not shown) of the walls 28. The floor 40 and the top surface extend between the side surfaces 36 of the walls 28 defining the door opening 14. Although the walls 28 of the building have been described as being fabricated from wood or steel with the plasterboard 16 applied to the front and rear surfaces 34, 38 of the walls 28, it is anticipated that the walls 28 may be fabricated from any other conventional materials used in the construction industry.

Figure 2:
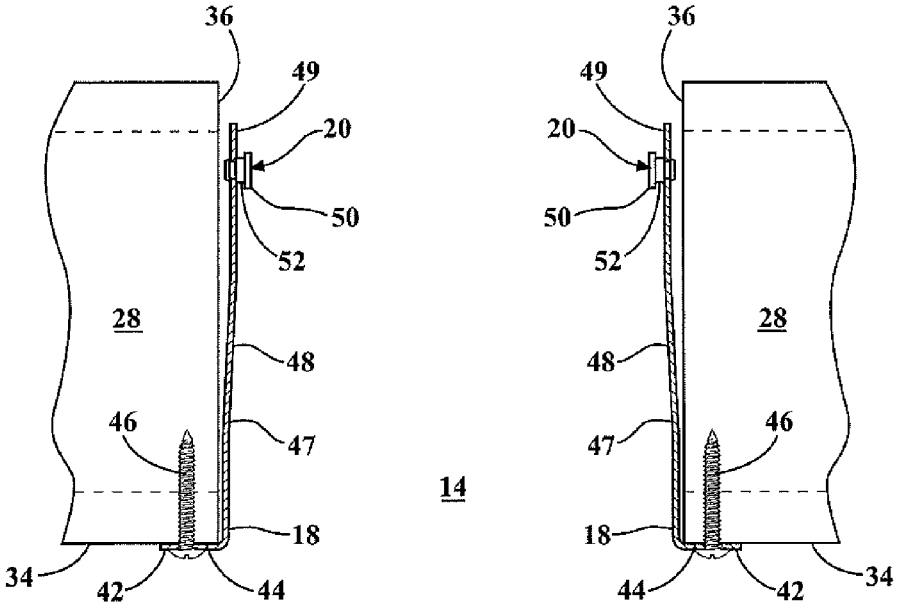
FIG. 2 is a sectional top plan view of the door opening showing the brackets and mounting pins of the apparatus and method for mounting a door frame of the present invention.

In order to mount the method and apparatus 10 of the present invention into the door opening 14 of the building, the brackets 18 are mounted within the door opening 14, as seen in FIG. 2. The brackets 18 consist of two, substantially similar brackets 18 wherein each bracket 18 extends along almost the entire length of one of the opposing side surfaces 36 of the walls 28 defining the door opening 14. The brackets 18 have a continuous one-piece configuration and are fabricated from a high-strength, lightweight material, such as aluminum or steel. The brackets 18 have an elongated, substantially L-shaped cross-sectional configuration wherein a short leg or flange 42 of the brackets 18 extends adjacent along the front surface 34 of the wall 28. A slotted aperture 44 is provided in and through the flange 42 of the bracket 18, and a conventional fastener 46 extends through the slotted aperture 44 and the front surface 34 of the wall 28 and into the wall 28 of the building to secure the brackets 18 to the wall 28. The slotted aperture 44 in the flange 42 of the bracket 18 allows the brackets 18 to slide horizontally relative to the fastener 46, thereby providing adjustment of the brackets 18 along the width 30 of the door opening 14 to and from a centerline of the door opening 14 such that the distance between the brackets 18 can be adjusted accordingly. A long leg 47 of the L-shaped cross-sectional configuration of each of the brackets 18 may have an inward taper or ramp 48 which allows an end portion 49 of the brackets 18 to extend inward toward one another and away from the side surface 36 of the walls 28 defining the door opening 14. The ramp 48 on each of the brackets 18 may be utilized to assist in the assembly of the door support frame 22 by guiding the door support frame 22 into a proper position within the door opening 14, as will be subsequently described. The mounting pins 20 are connected at the end portion 49 of the brackets 18 and extend inward into the door opening 14 toward one another. The mounting pins 20 have a substantially circular head 50 connected to a smaller stem 52 which is connected to the bracket 18. The mounting pins 20 of each bracket 18 directly oppose one another at a specific and predetermined distance within the door opening 14.

To secure the door support frame 22 to the brackets 18, the door support frame 22 is inserted into the door opening 14 from the front surface 34 of the walls 28, as seen in FIG. 3. The door support frame 22 may be fabricated from a high-strength, lightweight material, such as steel or aluminum, or it may be fabricated from other conventional building materials, such as wood. The door support frame 22 has a three-sided, substantially U-shaped configuration which extends along the side surfaces 36, the top surface, and the front surface 34 of the walls 28. Each one of the three sides of the door support frame 22 has a generally L-shaped cross-sectional configuration, wherein a shorter leg 53 of the L-shaped configuration of the door support frame 22 extends across and adjacent to the front surface 34 of the walls 28. A longer leg 55 of the L-shaped configuration of the door support frame 22 extends into the door opening 14 along the side surfaces 36 and top surface of the walls 28 and provides a bracket connecting portion 54 welded to a jamb 56. The jamb 56 has a substantially rectangular configuration and extends further into the door opening 14 along the width 30 of the door opening 14. The bracket connecting portion 54 of the door support frame 22 has the slot 24 formed in an end 57 of the door support frame 22 adjacent the mounting pin 20 of the bracket 18. The slot 24 of the door support frame 22 has an open-ended portion 59 extending angularly downward with an upward, closed-ended portion 61 in communication with the downwardly extending portion 59 of the slot 24, as seen in FIGS. 3A-3C. The mounting pin 20 engages the slot 24 by having the stem 52 of the mounting pin 20 enter the slot 24 at the open-ended portion of the slot 24, as seen in FIG. 3A, while the head 50 of the mounting pin 20 extends beyond the slot 24. The head 50 of the mounting pin 20 is larger than the slot 24, thereby preventing the head 50 of the mounting pin 20 from passing through the slot 24 and maintaining the stem 52 of the mounting pin 20 within the slot 24. The door support frame 22 is moved or lifted upward, as seen in FIG. 3B, thereby moving the mounting pin 20 down the slot 24 until the mounting pin 20 reaches the end of the downward portion 59 of the slot 24. The door support frame 22 is then moved downward such that the mounting pins 20 rest in the upward, closed-ended portion 61 of the slot 24, as seen in FIG. 3C. The configuration of the mounting pins 20 and slots 24 provides a "lift and drop" feature, wherein the door support frame 22 is lifted to allow the mounting pins 20 to engage the downward portion 59 of the slot 24. The door support frame 22 is then lowered to allow the mounting pins 20 to engage and rest in the closed-ended portion of the slots 24. Thus, the door support frame 22 is allowed to sit and hang from the mounting pins 20 of the brackets 18 without having the bottom of the door support frame 22 contacting the floor 40 of the building. This ensures that the door frame 12 will remain level and substantially perpendicular. The method and apparatus 10 also allows an installer to install the door support frame 22 with a door mounted thereon, and once the door support frame 22 is mounted to the bracket 18, the door support frame 22 will not fall back out of the door opening 14. In addition, the method and apparatus 10 secures the door support frame 22 to the brackets 18 without the need for a second installer.

Figure 3D:
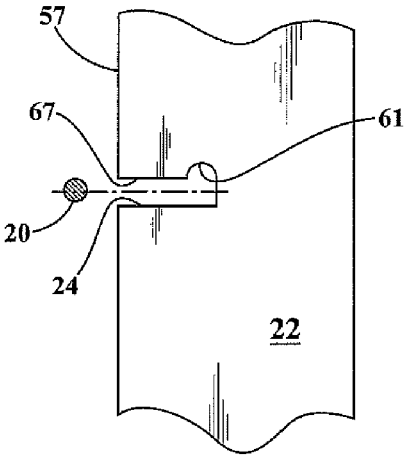
FIG. 3D is a schematic diagram showing a slide and drop embodiment of the mounting pin and the slot of the door support frame of the apparatus and method for mounting a door frame of the present invention.

In an alternative embodiment, the slot 24 in the door support frame 22 may have an open-ended substantially horizontal portion 67 with an upward, closed-ended portion 61 at the end of the slot 24, as seen in FIG. 3D. This allows the door support frame 22 to be slid horizontally along the mounting pins 20 and then dropped into position as opposed to lifting and dropping the door support frame 22, as described in the previous embodiment.

Figure 3E:
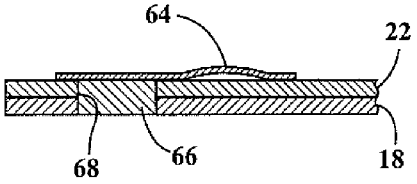
FIGS. 3E-3J are schematic diagrams showing alternative embodiments of the mounting pin and the slot of the door support frame of the apparatus and method for mounting a door frame of the present invention.
Figure 3F:
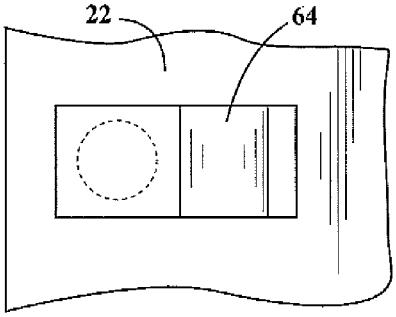
Figure 3G:
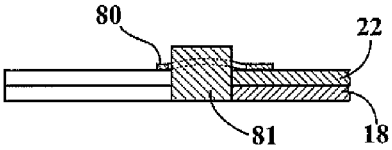
Figure 3H:
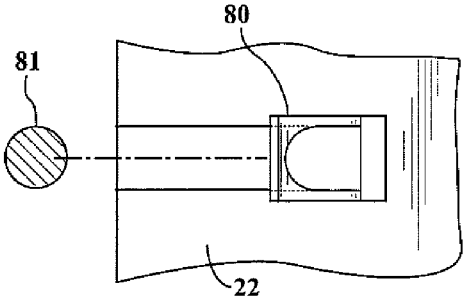
Figure 3I:
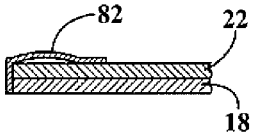
Figure 3J:
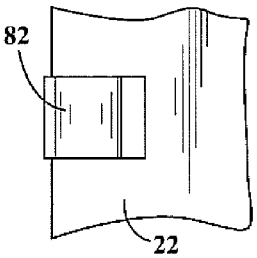
Figure 3K:
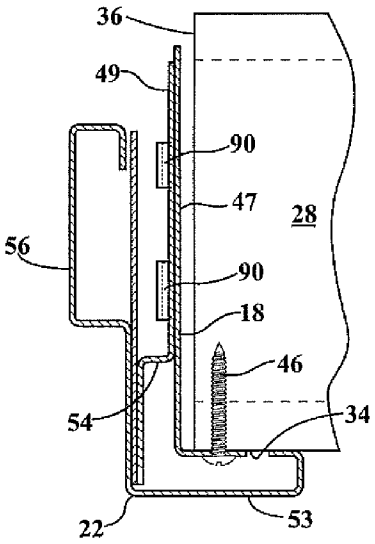
FIG. 3K is a sectional top view of the door opening showing a frame insertion tab embodiment of the brackets connected to the door support frame of the apparatus and method for mounting a door frame of the present invention.
Figure 3O:
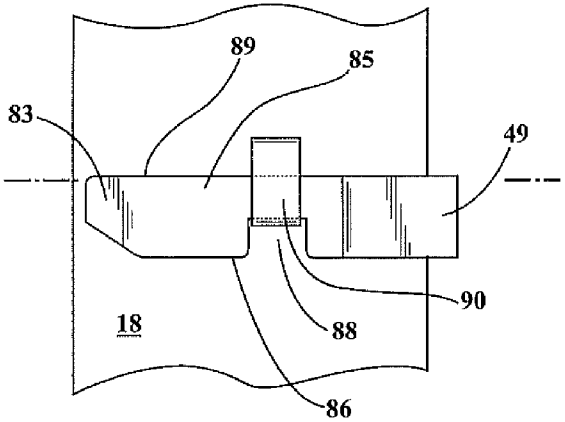
FIG. 3O is a schematic diagram showing the variation of the frame insertion tab embodiment of the apparatus and method for mounting a door frame of the present invention.

In other alternative embodiments, various clip and pin configurations may be utilized, as seen in FIGS. 3E-3O. In FIGS. 3E-3F, a spring clip 64 with an integral pin 66 mounted on the door support frame 22 is used to engage the pin 66 within a hole 68 provided in the bracket 18. In FIGS. 3G-3H, a spring clip 80 mounted on the door support frame 22 engages a pin 81 on the bracket 18. In FIGS. 3I-3J, a spring clip 82 is mounted on the door support frame 22 to engage an edge of the bracket 18.

In yet another alternative embodiment, a pair of similar frame insertion tabs 85 may be used to secure each of the brackets 18 to the door support frame 22 as seen in FIGS. 3K-3O. In this embodiment, a pair of substantially similar slots 90 is formed in each of the brackets 18. The slots 90 consist of substantially similar rectangular apertures extending through the long leg 47 of each the brackets 18 for receiving the frame insertion tabs 85. The slots 90 are located near the center of each bracket 18, and a portion 91 of the brackets 18 located between the slots 90 may be raised, lowered, or flush to the brackets 18. The frame insertion tabs 85 are connected to each side of the door support frame 22. The frame insertion tabs 85 have a substantially toothed configuration such that the frame insertion tabs 85 can pass through the slots 90 in the brackets 18. The frame insertion tabs 85 have a first end 83, a second end 84, a top edge 89, and a bottom edge 86. Along the bottom edge 86 of each frame insertion tab 85, there are two substantially similar, rectangular recesses 88. A tooth 87 is formed along the bottom edge 86 between the rectangular recesses 88. The first end 83 of the frame insertion tab 85 partially extends angularly downward toward the bottom edge 86 adjacent to one of the rectangular recesses 88.

Figure 3L:
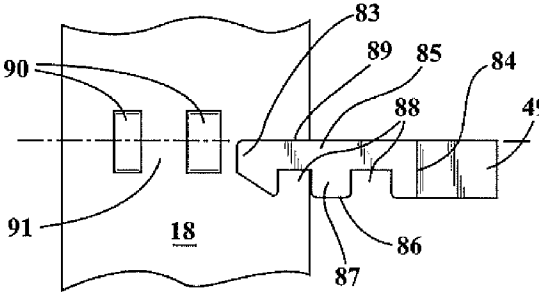
FIGS. 3L-3N are schematic diagrams showing the positions of the frame insertion tab embodiment of the door support frame relative to the slots in the brackets of the apparatus and method for mounting a door frame of the present invention.
Figure 3M:
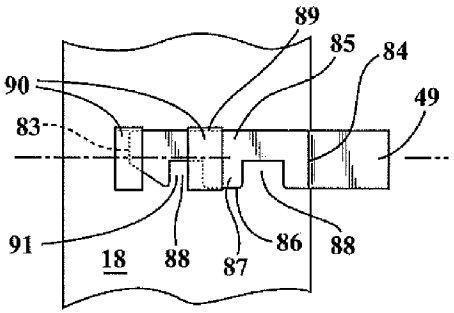
Figure 3N:
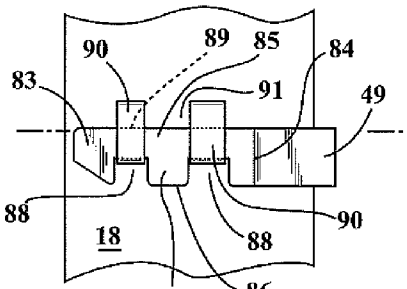

To secure the door support frame 22 to the brackets 18, the frame insertion tabs 85 engage the slots 90 in the brackets 18, as shown in FIGS. 3L-3N. The door support frame 22 is raised slightly, so that the frame insertion tabs 85 can pass through the slots 90 in the brackets 18, as shown in FIG. 3M. After the first end 83 of the frame insertion tab 85 has passed through both slots 90 in the bracket 18, and the tooth 87 is positioned between the slots 90 in the bracket 18, the door support frame 22 is lowered, as shown in FIG. 3N, allowing the rectangular recesses 88 on the frame insertion tab 85 to be seated in the slots 90 in the brackets 18.

Various themes and features of these designs are also anticipated. For instance, the mounting pin 20 and the slot 24 can be reversed such that the brackets 18 contain the slot 24, and the door support frame 22 contains the mounting pins 20. In addition, the spring clips 80, 82 and the mounting pins 20 can also be reversed such that the spring clips 80, 82 are mounted on the brackets 18, and the mounting pins 20 are mounted on the door support frame 22. The frame insertion tabs 85 and the slots 90 can be reversed such that the slots 90 are on the end 57 of the door support frame 22 and the frame insertion tabs 85 are on the brackets 18. Similarly, it is anticipated that the number of slots 90 and teeth 87 could be increased or decreased. If there is only one slot 90 in the bracket 18, only one rectangular recess 88 in the frame insertion tab 85 is needed. The rectangular recess 88 will rest in the slot 90 when the door support frame 22 is secured to the brackets 18, as seen in FIG. 30.

Figure 4:
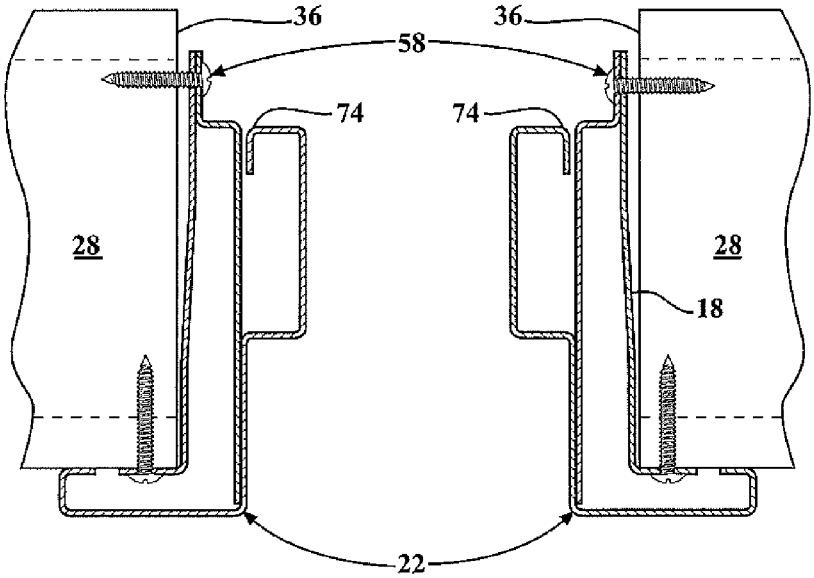
FIG. 4 is a sectional top plan view of the bracket and the door support frame of the apparatus and method for mounting a door frame of the present invention connected to the walls of the building.

Once the door support frame 22 is connected to the brackets 18 via one of the above-noted embodiments, conventional fasteners 58 may be inserted through corresponding apertures (not shown) in the brackets 18 and the door support frame 22, wherein the fasteners 58 are driven through the side surfaces 36 of the walls 28 and into the walls 28 defining the door opening 14 to secure the brackets 18 and the door support frame 22 to the walls 28 of the building, as seen in FIG. 4.

Figure 5:
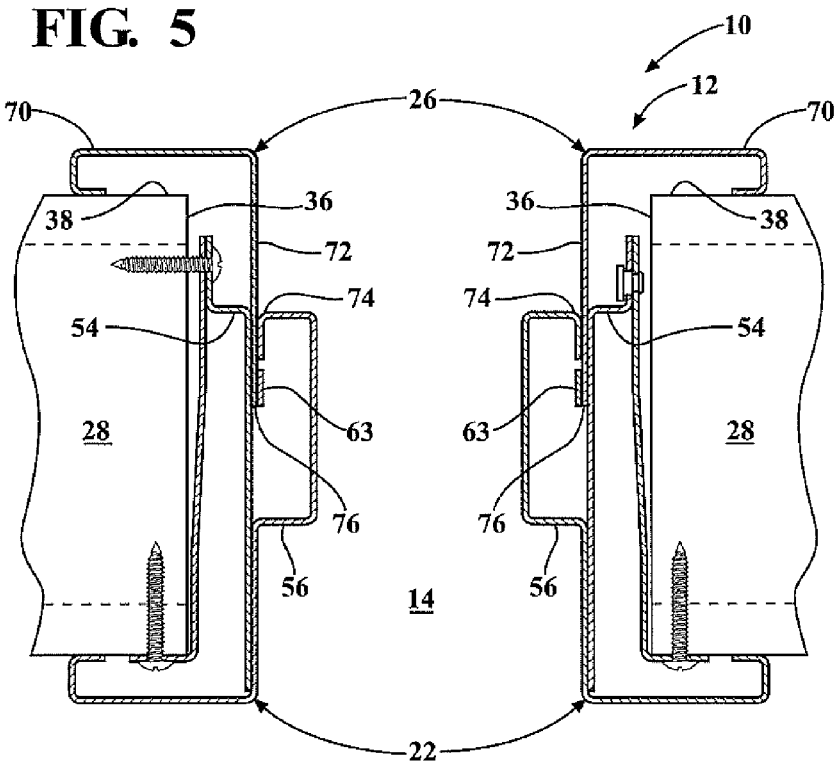
FIG. 5 is a sectional top plan view of the trim frame connected to the door support frame of the apparatus and method for mounting a door frame of the present invention.
Figure 6A:
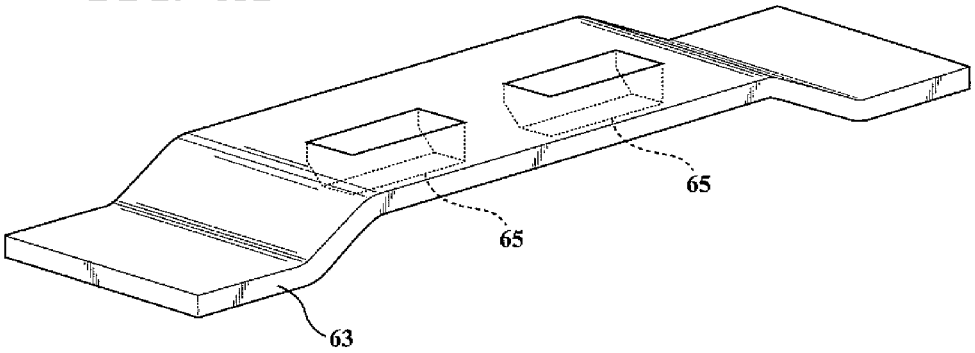
FIG. 6A is a perspective view showing the locking tabs of the door support frame used to receive the trim frame of the apparatus and method for mounting a door frame of the present invention.
Figure 6B:
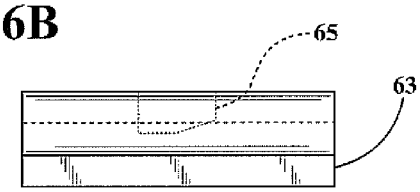
FIG. 6B is a side plan view showing the locking tabs of the door support frame used to receive the trim frame of the apparatus and method for mounting a door frame of the present invention.
Figure 6C:
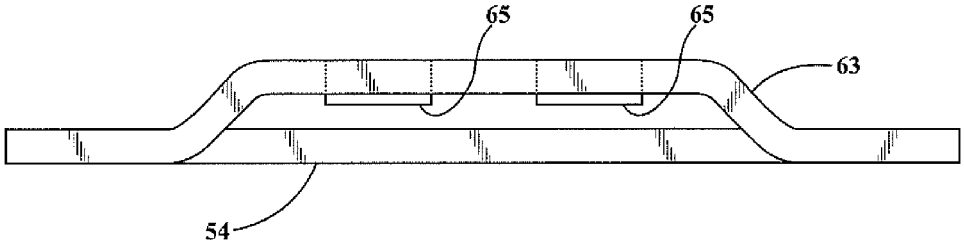
FIG. 6C is a front plan view showing the locking tabs of the door support frame used to receive the trim frame of the apparatus and method for mounting a door frame of the present invention.
Figure 7A:
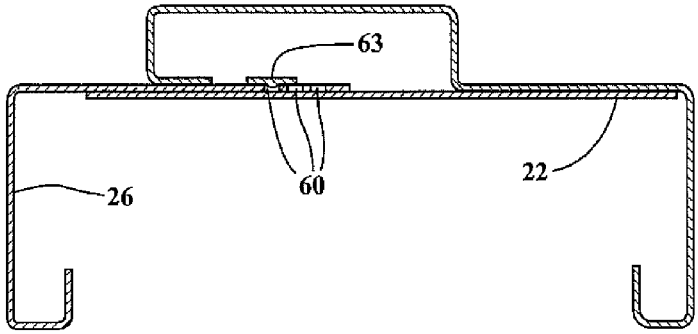
FIG. 7A-7E are plan views of the adjustable positioning feature of the trim frame to the door support frame of the apparatus and method for mounting a door frame of the present invention.
Figure 7B:
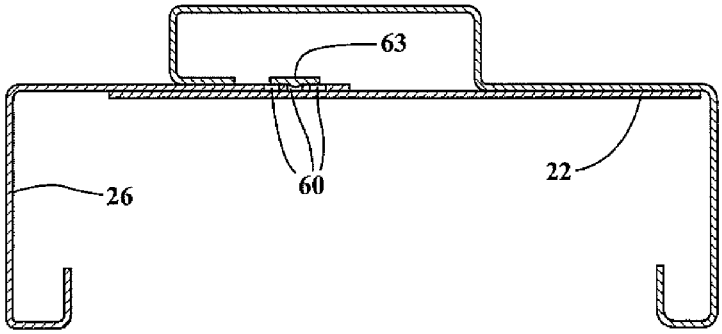
Figure 7C:
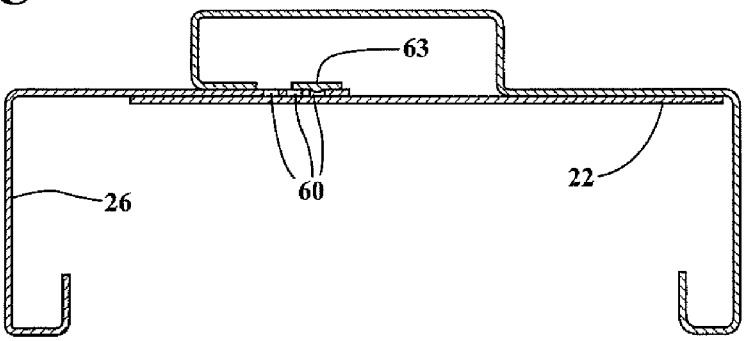
Figure 7D:
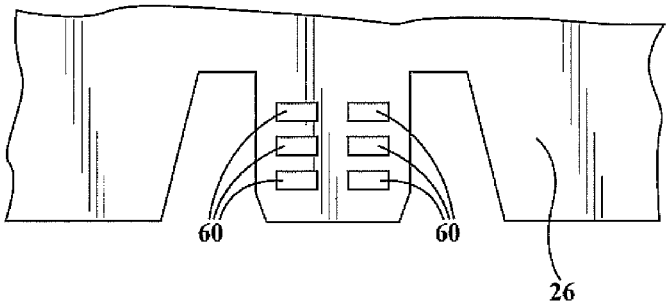
Figure 7E:
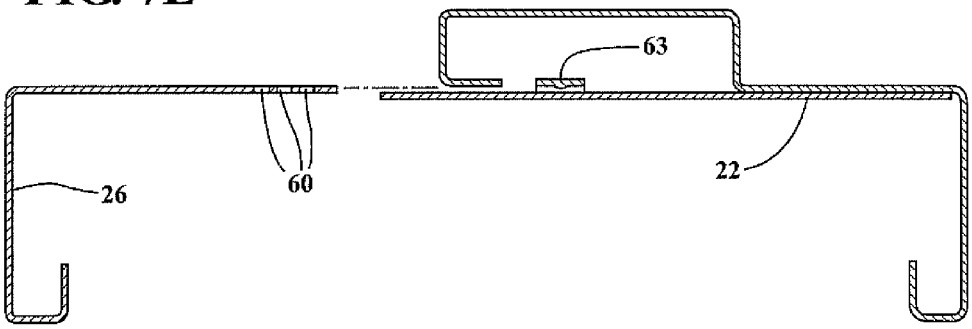
Figure 8:
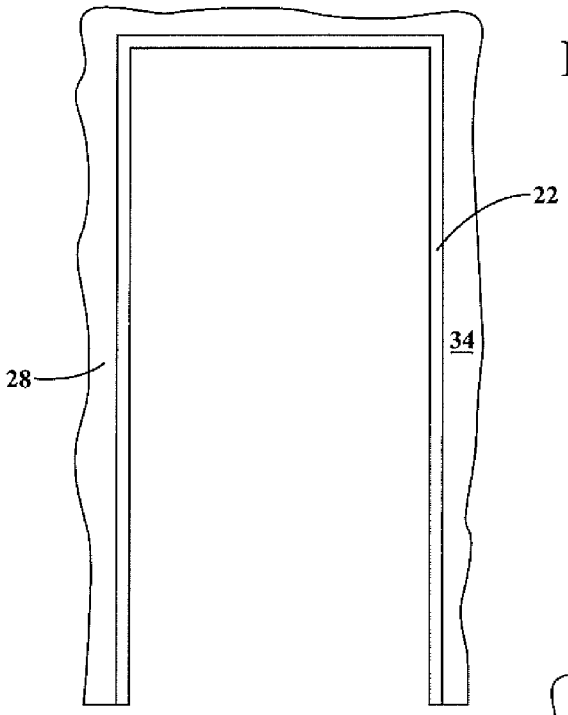
FIG. 8 is a front view showing the apparatus and method for mounting a door frame of the present invention installed in the door opening.
Figure 9:
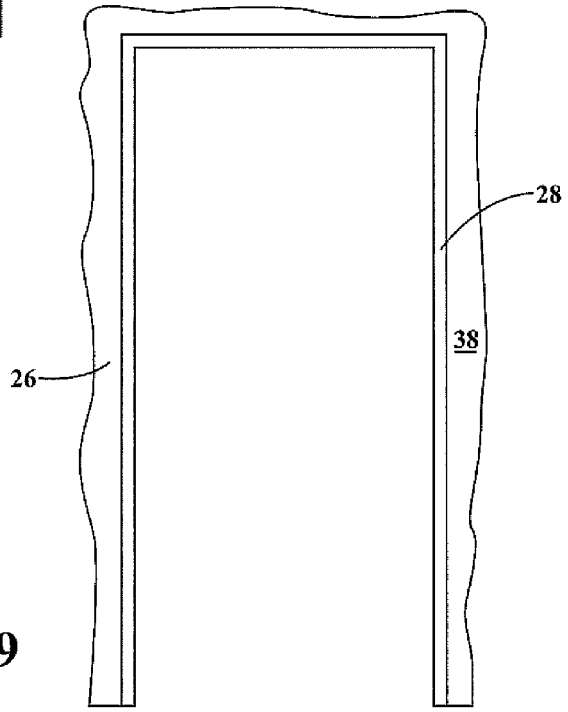
FIG. 9 is a rear view showing the apparatus and method for mounting a door frame of the present invention installed in the door opening.

In order to install the trim frame 26 to the door support frame 22, the trim frame 26 is inserted from the rear surface 38 of the walls 28 defining the door opening 14 of the building, as seen in FIG. 5. The trim frame 26 is also three-sided with a substantially U-shaped configuration, such that the trim frame 26 extends along the side surfaces 36 and the top surface of the walls 28 defining the door opening 14. The trim frame 26 also has a generally L-shaped cross-sectional configuration, wherein a short leg 70 of the L-shaped configuration extends along the rear surface 38 of the walls 28 defining the door opening 14, and a long leg 72 of the L-shaped configuration extends along the entire side surfaces 36 and top surface of the walls 28 defining the door opening 14. The trim frame 26 is also made of a lightweight, high-strength material, such as aluminum or steel; however, the trim frame 26 may also be fabricated from wood or any other conventional construction material. The long leg 72 of the trim frame 26 is inserted through a gap 74 provided between the bracket connecting portion 54 and the jamb 56 of the door support frame 22. The end 76 of the long leg 72 of the trim frame 26 may have a plurality of slots 60 formed therein. The slots 60 in the trim frame 26 may be received by locking tabs 65 formed on a raised ridge 63 on the bracket connecting portion 54 of the door support frame 22 within the jamb 56, as seen in FIGS. 6A-6C. The plurality of slots 60 in the trim frame 26 allow for adjustment of the trim frame 26 relative to the door support frame 22 by inserting the trim frame 26 further into the gap 74 formed between the bracket connecting portion 54 and the jamb 56 of the door support frame 22, as seen in FIGS. 7A-7E. The engagement of the slots 60 and locking tabs 65 provide a ratcheting effect, thereby allowing for easy positional adjustment of the trim frame 26 relative to the door support frame 22 in three possible positions, as shown in FIGS. 7A-7C. The locking tabs 62 on the bracket connecting portion 54 of the door support frame 22 engage the slots 60 in the trim frame 26. The trim frame 26 is the same size as the door support frame 22, so when the trim frame 26 is connected to the door support frame 22, the trim frame 26 will also hang from the door support frame 22 off the floor 40 of the building. Again, this will ensure that the trim frame 26 remains level and substantially perpendicular as well. Once the trim frame 26 is securely connected to the door support frame 22, the method and apparatus 10 of the present invention is complete.

In operation, the brackets 18 are mounted in the door opening 14 of the building by having the fasteners 46 connect the brackets 18 to the front surface 34 of the walls 28 defining the door opening 14 of the building. When doing so, one of the brackets 18 is mounted directly adjacent to, but not touching, the higher side of the floor 40 defining the door opening 14. Once one of the brackets 18 is mounted adjacent to the highest side of the floor 40, the other bracket 18 may be mounted at the same height directly across from and substantially parallel to the opposing bracket 18. Once the height of the brackets 18 are determined, then the distance between the brackets 18 or the width 30 of the door opening 14 may be adjusted by sliding the brackets 18 along the fasteners 46 positioned in the slotted apertures 44 of the brackets 18. The fasteners 46 are then threaded through the front surface 34 of the wall 28 and into the wall 28 of the building to secure the brackets 18 to the walls 28. The door support frame 22 is moved into position for assembly to the brackets 18 by moving the door support frame 22 toward the front surface 34 of the wall 28 defining the door opening 14 and engaging the ramp 48 of the bracket 18 to guide the door support frame 22 into a proper position within the door opening 14. The ramp 48 and the slotted apertures 44 in the bracket 18 provide a means to create the perfect dimension between the brackets 18. The door support frame 22 is positioned such that the slots 24 in the door support frame 22 are positioned adjacent to the mounting pins 20 on the brackets 18. The mounting pins 20 on the brackets 18 are received in the open-ended slots 24 of the door support frame 22 and slid into position at the closed-ended portion of the slots 24, thereby allowing the door support frame 22 to sit and hang from the mounting pins 20. The fasteners 58 are inserted through corresponding apertures in the brackets 18 and the door support frame 22 and through the side surfaces 36 of the walls 28 and into the walls 28 to secure the brackets 18 and the door support frame 22 to the walls 28 of the building. The trim frame 26 is then brought in from the rear surface 38 of the walls 28 defining the door opening 14 such that the long leg 72 of the L-shaped configuration of the trim frame 26 is inserted through the gap 74 between the bracket connecting portion 54 and the jamb 56 of the door support frame 22. The slots 60 in the long leg 72 of the trim frame 26 are engaged by the locking tabs 62 on the raised ridge 63 of the door support frame 22 so as to secure the trim frame 26 to the door support frame 22. The trim frame 26 is pushed toward the door support frame 22, thereby ratcheting the locking tabs 62 along the slots 60 of the trim frame 26 until the trim frame 26 is in the proper position, wherein the trim frame 26 hangs with and from the door support frame 22. The assembly of the method and apparatus 10 of the present invention is then complete.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An apparatus for mounting a door frame to a door opening defined by walls of a building, wherein said door opening is defined by a pair of substantially parallel side surfaces of said walls, and a floor substantially parallel to a top surface of said walls, wherein said floor and said top surface extend between said side surfaces of said walls, comprising:

a pair of substantially similar brackets, wherein each one of said brackets is connectable to one of said pair of side surfaces of said walls, each of said brackets having a slotted aperture for receiving a fastener connectable to said walls wherein said brackets may adjustably slide along said fastener relative to said side surfaces of said walls;

a door support frame connected to said brackets; and a trim frame connected to said door support frame for securing said trim frame in said door opening of said building.

2. The apparatus for mounting a door frame of claim 1, further comprising:

each of said brackets having an inward taper or ramp that allows an end portion of said bracket to extend inward and away from said side surfaces of said walls for engaging said door support frame.

3. The apparatus for mounting a door frame of claim 1, further comprising:

each of said brackets having one of a spring clip with an integral pin or an aperture formed therein, and said door support frame having the other of said spring clip with said integral pin or aperture formed therein, such that said integral pin engages said aperture, thereby connecting said door support frame to said brackets.

4. The apparatus for mounting a door frame of claim 1, further comprising:

each of said brackets having one of a spring clip or a pin, and said door support frame having the other of said spring clip or said pin, such that said spring clip engages said pin, thereby connecting said door support frame to said brackets.

5. The apparatus for mounting a door frame of claim 1, further comprising:

each of said brackets having at least one slot formed therein or a frame insertion tab, and said door support frame having the other of said at least one slot formed therein or said frame insertion tab, such that said frame insertion tab engages said at least one slot formed therein, thereby connecting said door support frame to said pair of brackets.

6. The apparatus for mounting a door frame of claim 1, further comprising:

said door support frame having a generally U-shaped configuration that extends along said side surfaces of said walls, said top surface of said walls, and said front surface of said walls, and said door support frame having a generally L-shaped cross-sectional configuration with a short leg and a long leg.

7. The apparatus for mounting a door frame of claim 1, further comprising:

said trim frame having a generally L-shaped cross-sectional configuration with a short leg and a long leg, wherein said long leg of said trim frame engages said door support frame, thereby connecting said trim frame to said door support frame.

8. An apparatus for mounting a door frame to a door opening defined by walls of a building, wherein said door opening is defined by a pair of substantially parallel side surfaces of said walls, and a floor substantially parallel to a top surface of said walls, wherein said floor and said top surface extend between said side surfaces of said walls, comprising:

a pair of substantially similar brackets, wherein each of said brackets is connectable to one of said pair of side surfaces of said brackets, each of said brackets having one of a mounting pin or a slot formed therein, and said door support frame having the other of said mounting pin or said slot formed therein, such that said mounting pin engages said slot, thereby connecting said door support frame to said brackets;

a door support frame connected to said brackets; and a trim frame connected to said door support frame for securing said trim frame in said door opening of said building.

9. The apparatus for mounting a door frame of claim 8, further comprising:

each of said mounting pins having a substantially circular head connected to a smaller stem, wherein said stem is smaller than said slot for engaging said slot, and said head is larger than said slot to prevent said head from passing through said slot, thereby connecting said door support frame to said brackets.

10. The apparatus for mounting a door frame of claim 8, further comprising:

each of said slots having an open-ended portion extending angularly downward with an upward, closed-ended portion in communication with said angularly downward portion of said slot.

11. The apparatus for mounting a door frame of claim 8, further comprising:

each of said slots having a substantially horizontal open-ended portion with an upward, closed-ended portion in communication with said horizontal open-ended portion of said slot.

12. The apparatus for mounting a door frame of claim 8, further comprising:

said door support frame having a generally U-shaped configuration that extends along said side surfaces of said walls, said top surface of said walls, and said front surface of said walls, and said door support frame having a generally L-shaped cross-sectional configuration with a short leg and a long leg.

13. The apparatus for mounting a door frame of claim 8, further comprising:

said trim frame having a generally L-shaped cross-sectional configuration with a short leg and a long leg, wherein said long leg of said trim frame engages said door support frame, thereby connecting said trim frame to said door support frame.

14. The apparatus for mounting a door frame of claim 8, further comprising:

each of said brackets having an inward taper or ramp that allows an end portion of said bracket to extend inward and away from said side surfaces of said walls for engaging said door support frame.

15. An apparatus for mounting a door frame to a door opening defined by walls of a building, wherein said door opening is defined by a pair of substantially parallel side surfaces of said walls, and a floor substantially parallel to a top surface of said walls, wherein said floor and said top surface extend between said side surfaces of said walls, comprising:

a pair of substantially similar brackets, wherein one of each one of said brackets is connectable to one of said pair of side surfaces of the walls;

a door support frame connected to said brackets, said door support having a generally U-shaped configuration that extends along said surfaces of said walls, said top surface of said walls, and said front surface of said walls, and said door support frame having a Generally L-shaped cross-sectional configuration with a short leg and a long leg;

a trim frame connected to said door support frame for securing said trim frame in said door opening of said building; and a jamb having a substantially rectangular configuration, wherein said jamb is connected to said longer leg of said door support frame.

16. The apparatus for mounting a door frame of claim 15, further comprising:

said trim frame extending between said jamb and said longer leg of said door support frame, thereby connecting said trim frame to said door support frame.

* * * * *